US010655401B2

(12) United States Patent
Azar et al.

(10) Patent No.: US 10,655,401 B2
(45) Date of Patent: May 19, 2020

(54) ENERGY-EMITTING BITS AND CUTTING ELEMENTS

(71) Applicant: SCHLUMBERGER TECHNOLOGY CORPORATION, Sugar Land, TX (US)

(72) Inventors: Michael G. Azar, The Woodlands, TX (US); Madapusi Keshavan, Oceanside, CA (US); Iain Michael Cooper, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/079,116

(22) PCT Filed: Feb. 22, 2017

(86) PCT No.: PCT/US2017/018773
§ 371 (c)(1),
(2) Date: Aug. 23, 2018

(87) PCT Pub. No.: WO2017/151353
PCT Pub. Date: Sep. 8, 2017

(65) Prior Publication Data

US 2019/0055789 A1 Feb. 21, 2019

Related U.S. Application Data

(60) Provisional application No. 62/301,220, filed on Feb. 29, 2016.

(51) Int. Cl.
*E21B 10/62* (2006.01)
*E21B 10/43* (2006.01)
*E21B 7/14* (2006.01)
*E21B 7/15* (2006.01)

(52) U.S. Cl.
CPC ..... *E21B 10/62* (2013.01); *E21B 7/14* (2013.01); *E21B 7/15* (2013.01); *E21B 10/43* (2013.01)

(58) Field of Classification Search
CPC ... E21B 7/14; E21B 7/15; E21B 10/62; E21B 10/43
See application file for complete search history.

(56) References Cited

U.S. PATENT DOCUMENTS

| | | | |
|---|---|---|---|
| 7,147,064 | B2 | 12/2006 | Batarseh et al. |
| 8,109,345 | B2 | 2/2012 | Jeffryes |
| 8,550,182 | B2 | 10/2013 | Ouellet et al. |
| 9,168,612 | B2 | 10/2015 | Wilkiel et al. |

(Continued)

OTHER PUBLICATIONS

International Preliminary Report on Patentability issued in International Patent application PCT/US2017/018773 dated Sep. 13, 2018, 10 pages.

(Continued)

*Primary Examiner* — Kristyn A Hall

(57) ABSTRACT

A cutting element has a port extending through at least a portion of the cutting element body. A cutting face of the cutting element includes an ultrahard material. The port is configured to provide fluid communication therethrough and to direct focused energy from a focused energy source through the cutting element toward a formation proximate the cutting face.

20 Claims, 8 Drawing Sheets

(56) References Cited

U.S. PATENT DOCUMENTS

| | | | | |
|---|---|---|---|---|
| 9,212,546 | B2 | 12/2015 | Scott et al. | |
| 2010/0078414 | A1 | 4/2010 | Perry et al. | |
| 2012/0255774 | A1 | 10/2012 | Grubb et al. | |
| 2014/0027178 | A1 | 1/2014 | Jeffryes et al. | |
| 2015/0068804 | A1 | 3/2015 | Keshavan et al. | |
| 2015/0218935 | A1* | 8/2015 | Pelletier | E21B 47/02216 175/41 |

OTHER PUBLICATIONS

International Search Report and Written Opinion issued in International Patent Application No. PCT/US2017/018773 dated May 23, 2017, 13 pages.

* cited by examiner

ENERGY-EMITTING BITS AND CUTTING ELEMENTS

CROSS-REFERENCE TO RELATED APPLICATIONS

This application claims the benefit of, and priority to, U.S. Patent Application No. 62/301,220, filed Feb. 29, 2016, which application is expressly incorporated herein by this reference in its entirety.

BACKGROUND

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

The drilling system may drill a wellbore or other borehole through a variety of formations. The formation may include geologic formations ranging from unconsolidated material to rock formations such as granite, basalt, or metamorphic formations. The drilling system may include a drill bit with a plurality of cutting elements located on the bit to loosen material from the formation to create the wellbore. The cutting elements may include a cutting edge or surface on that is sufficiently durable to penetrate through the formation and maintain desirable uptime of the drilling system.

Harder formations (i.e., geologic formations including harder rocks or other materials) increase wear on a drill bit and the cutting elements mounted on the drill bit compared to softer formations. The increased wear in harder formations increases the risk of failure of a cutting element or the drill bit and, therefore, increases the risk of damage to the drilling system. The increased wear in harder formations reduces the operational lifetime of a cutting element and drill bit, which in-turn increases the time and cost involved in retrieving the drill bit from the wellbore, replacing or repairing the drill bit, and tripping the drill bit back into the wellbore.

SUMMARY

In some embodiments, an energy-emitting cutting element includes a body having a rear face, a cutting face, and a longitudinal axis extending therethrough. The cutting face includes an ultrahard material. A port extends through at least part of the body and parallel to the longitudinal axis. The port provides fluid communication within at least part of the body. An energy direction member extends through at least part of the port.

According to some embodiments, a laser-mechanical bit includes a bit body with a first longitudinal axis. The bit also includes a focused energy source and an energy-emitting cutting element. The energy-emitting cutting element is coupled to the bit body and is in communication with the focused energy source. The energy-emitting cutting element includes a body having a cutting face and a second longitudinal axis extending therethrough. The cutting face includes an ultrahard material. A port extends through at least part of the body parallel to the second longitudinal axis and at a non-zero angle relative to the first longitudinal axis.

The port provides fluid communication through at least part of the body. An energy direction member extends within at least part of the port and communicates with the focused energy source.

In yet additional embodiments, a method for removing material from a formation includes providing an energy-emitting cutting element having a port extending at least partially therethrough. The method also includes flowing a fluid through the port of the energy-emitting cutting element, and emitting energy from the port of the energy-emitting cutting element toward an energized portion of a formation at a non-perpendicular incident angle. The energy weakens at least part of the formation by energizing, heating, or expanding the energized portion of the formation. A weakened portion of the formation is then removed through mechanical removal, such as a shear cutting element or a conical cutting element.

This summary is provided to introduce a selection of concepts that are further described herein. This summary is not intended to identify key or essential features of the claimed subject matter, nor is it intended to be used as an aid in limiting the scope of the claimed subject matter. Additional features and aspects of embodiments of the disclosure will be set forth in the description that follows, will be apparent to one skilled in the art in view of the disclosure herein, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

Some embodiments of the present disclosure generally relate to devices, systems, and methods for producing cutting devices for creating a wellbore in earthen or other material. In some embodiments, a mechanical bit may include one or more energy-emitting elements. For instance, one or more focused energy sources may be used to weaken, fracture, or otherwise degrade earthen or other material adjacent the mechanical drill bit. For example, a laser-mechanical bit may include one or more focused energy sources directed through at least a portion of a cutting element, such as a polycrystalline diamond (PCD) compact. In other examples, a laser-mechanical bit may include one or more focused energy sources directed through a fluid nozzle in the drill bit body, or through an optical window in the bit body. In some embodiments, a focused energy source may include an optical energy source, such as a laser. While the present disclosure may describe embodiments of a bit having one or more focused energy sources as a laser-mechanical bit, in other embodiments, a laser-mechanical bit may include a focused energy source utilizing other energy sources such as other electromagnetic waves (including microwaves, radio waves, or other frequency waves), acoustic waves, other waves or focused energy sources, or combinations of the foregoing.

A focused energy source may direct energy toward the formation or other material adjacent the laser-mechanical bit. The formation may receive energy from the focused energy source, and the received energy may heat or otherwise energize at least part of the formation. The received energy may directly or indirectly fracture, degrade, or otherwise weaken the formation. For example, the received energy may energize a plurality of minerals or materials, such as in heterogeneous formations (e.g., granites, basalts, schists, shales, etc.), or energize a single mineral or material, such as in homogenous formations. Minerals in the heterogeneous formations may have different coefficients of thermal expansion increasing strain within the formation to fracture or otherwise weaken the energized portion of the formation. In other examples, the received energy may heat or otherwise energize a fluid (e.g., water) in the formation. The energized fluid may vaporize or expand in cracks or pores in the formation, applying pressure to the surrounding formation to weaken the energized portion of the formation.

In some embodiments, a transmission fluid may be provided through one or more ports in the laser-mechanical bit to transmit energy to the formation more efficiently than through atmospheric or natural downhole conditions. In some embodiments, the transmission fluid itself may be heated or otherwise energized by the focused energy source to fracture or otherwise weaken the formation adjacent to the laser-mechanical bit.

Figure 1:
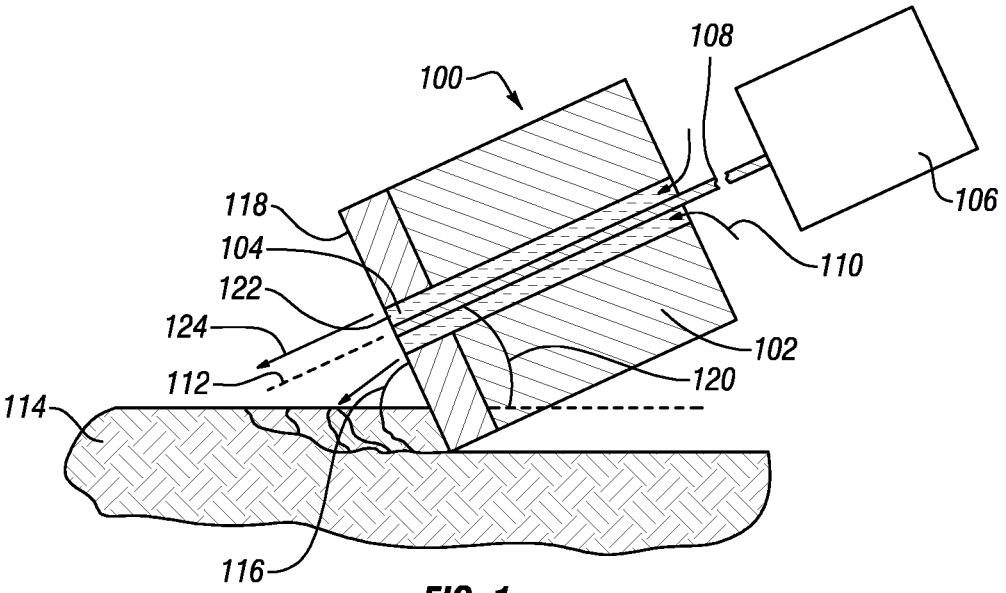
FIG. 1 is a side cross-sectional view of an energy-emitting cutting element, according to some embodiments of the present disclosure.

FIG. 1 illustrates a cutting element 100 having a body 102 with a port 104 extending at least partially therethrough, according to some embodiments of the present disclosure. A focused energy source 106 may provide energy through the port 104. In some embodiments, the energy may be directed through the port 104. For example, the port 104 may include an energy direction member 108, such as a fiber optic member, a mirrored cylinder, an incompressible gel, another medium capable of transmitting or directing energy, or combinations thereof. The energy direction member 108 may extend through at least a portion of the port 104. The energy direction member 108 may receive energy from the focused energy source 106 and may direct the energy through at least a portion of the port 104 and toward a cutting face 118 of the cutting element 100.

In some embodiments, the port 104 may be formed in the cutting element 100 by any applicable manufacturing method, including but not limited to, electrical discharge machining (EDM), laser ablation, hydrojets, drilling, or combinations thereof. In other embodiments, the cutting element 100 may be formed concurrently with the port 104. In some examples, the cutting element 100 and port 104 may be formed by additive manufacturing to form the port 104 in the cutting element 100 as the cutting element 100 is built up. In other examples, the port 104 may be formed by casting the cutting element 100 with a mandrel, post, protrusion, or other structure at least partially extending through the mold such that the cutting element 100 is cast with the port 104 in the cutting element 100.

In some embodiments, the port 104 may include a fluid 110 therein. The fluid 110 may be a transmission fluid that allows transmission of the energy (i.e. optical energy) from the focused energy source 106. For example, the fluid 110 may be optically clear at the wavelength emitted by the focused energy source 106. In some embodiments, the fluid 110 may transmit a percentage of the energy from the focused energy source 106 in a range having lower values, upper values, or lower and upper values including any of 50%, 60%, 70%, 80%, 90%, 100%, or any value therebetween. For example, a fluid 110 may transmit energy at the wavelength emitted by the focused energy source 106 (e.g., 600 nm) and opaque at other wavelengths (e.g., 800 nm). In some examples, the fluid 110 may transmit greater than 50% of the energy emitted at the wavelength of the focused energy source 106. In other examples, the fluid 110 may transmit greater than 60% of the energy emitted at the wavelength of the focused energy source 106. In yet other examples, the fluid 110 may transmit greater than 70% of the energy emitted at the wavelength of the focused energy source 106. In further examples, the fluid 110 may transmit greater than 80%, or between 80% and 100%, of the energy emitted at the wavelength of the focused energy source 106. In yet further examples, the fluid 110 may transmit greater than 90% of the energy emitted at the wavelength of the focused energy source 106. In still other embodiments, less than 50% of the energy emitted at the wavelength of the focused energy source 106 may be transmitted through the fluid 110.

In some embodiments, the fluid 110 may be a gas, a liquid, a gel, a suspension, a solution, any other fluid, or combinations thereof. For example, the fluid 110 may be water, air, nitrogen, oil, a water-based drilling fluid, an oil-based drilling fluid, other fluid, or combinations thereof.

The cutting element 100 may have a longitudinal axis 112 that extends through the body 102 and cutting face 118 of the cutting element 100. In some embodiments, the port 104 may be oriented coaxially (i.e., sharing an axis) with the longitudinal axis 112. In other embodiments, the port 104 may be oriented parallel to the longitudinal axis 112. In other embodiments, the port 104 may be nonparallel to (e.g., at an angle to or otherwise nonparallel with) the longitudinal axis 112. When nonparallel to the longitudinal axis 112, the port 104 may or may intersect the longitudinal axis 112 along the length of the cutting element 100, or the port 104 may be skewed and may not intersect the longitudinal axis 112 along the length of the cutting element 100.

A port 104 coaxial with the longitudinal axis 112 of the cutting element 100 may allow energy from the focused energy source 106 to be directed toward a portion of a formation 114 forward of the movement of the cutting element 100. A cutting element 100 may be oriented at a variety of angles relative to the formation 114. In some embodiments, a face angle 116 may be the orientation of the cutting face 118 of the cutting element 100 relative to the formation 114. The face angle 116 may be in a range having lower values, upper values, or both lower and upper values including any of 0° (i.e., perpendicular to the formation 114), 10°, 20°, 30°, 40°, 50°, 60°, 70°, 80°, 90° (i.e., tangential to the formation 114), or any value therebetween. In some examples, the face angle 116 may be between 0° and 90°. In other examples, the face angle 116 may be between 20° and 85°. In yet other examples, the face angle 116 may be between 40° and 80°. In further examples, the face angle 116 may be between 60° and 75°.

In some embodiments of a cutting element 100 having a port 104 perpendicular or otherwise oriented relative to the cutting face 118, the face angle 116 may be the same as an energy angle 120 of the energy directed (e.g., by an energy direction member 108) through the port 104 toward and relative to the formation 114. In other embodiments, the energy angle 120 may be different than the face angle 116. For example, the energy angle 120 may be in a range having a lower value, an upper value, or both lower and upper values including any of 0° (i.e., perpendicular to the formation 114), 10°, 20°, 30°, 40°, 50°, 60°, 70°, 80°, 90° (i.e., tangential to the formation 114), or any value therebetween. In some examples, the energy angle 120 may be between 0° and 90°. In other examples, the energy angle 120 may be between 5° and 70°. In yet other examples, the energy angle 120 may be between 10° and 50°. In further examples, the energy angle 120 may be between 15° and 30° or between 60° and 75°.

In some embodiments, the cutting face 118, the body 102, or both the cutting face 118 and the body 102 of the cutting element 100 may be made of or include ultrahard materials such as thermally stable polycrystalline diamond (TSP), binder-leeched polycrystalline diamond (PCD) (e.g., cobalt-leeched), binderless PCD, magnesium carbonate PCD, PCD-coated tungsten carbide, sintered tungsten carbide, cubic boron nitride, carbon nitride, boron carbon nitride, tungsten carbide doped with titanium carbide, tantalum carbide, niobium carbide, silicon carbide, alumina, other materials with a hardness exceeding 80 HRa (Rockwell Hardness A), or combinations thereof. In some embodiments, the cutting element 100 may be a monolithic PCD. For example, the cutting element 100 may be a PCD compact without an attached substrate or binding phase. In other embodiments, the cutting element 100 may be made of or include an impregnated insert such as a grit hot-pressed insert (GHI), or may include other materials.

In some embodiments, the focused energy source 106 may be a laser source or other energy source such as an energy source that provides other electromagnetic waves (including microwaves, radio waves, or other frequency waves) or acoustic waves. For example, the laser source may be have a mean energy output in a range having lower values, upper values, or both lower and upper values including any of 5 kW, 10 kW, 20 kW, 30 kW, 40 kW, 50 kW, 60 kW, 70 kW, 80 kW, or any value therebetween. For example, the laser source may have a mean energy output in a range of 5 kW to 80 kW. In other examples, the laser source may have a mean energy output in a range of 10 kW to 65 kW. In yet other examples, the laser source may have a mean energy output in a range of 20 kW to 50 kW. In other embodiments, the laser source may have a mean energy output less than 5 kW or greater than 80 kW. Any suitable type of laser may be used, including chemical lasers, dye lasers, gas lasers, gas dynamic lasers, free electron lasers, metal-vapor lasers, Raman lasers, Samarium lasers, semiconductor lasers, solid-state lasers, other lasers, or combinations of the foregoing.

In some embodiments, the energy from the focused energy source 106 may be directed through the port 104 toward the formation in the direction of the port 104. In other embodiments, the port 104 may include a diffuser 122, such as a lens, that may disperse the energy from the focused energy source 106 in a beam 124 projected from the cutting element 100 outward toward the formation 114. For example, the beam 124 may project outward from the cutting face 118 of the cutting element 100. In other examples, the beam 124 may project outward from the body 102 of the cutting element 100. The beam 124 may have a variety of shapes, geometries, or other configurations. In still other embodiments, the port 104 may include a lens or other component used to focus energy that may be dispersed while in the port 104 to further focus the energy projecting from the cutting element 100 toward the formation 114.

Figure 2:
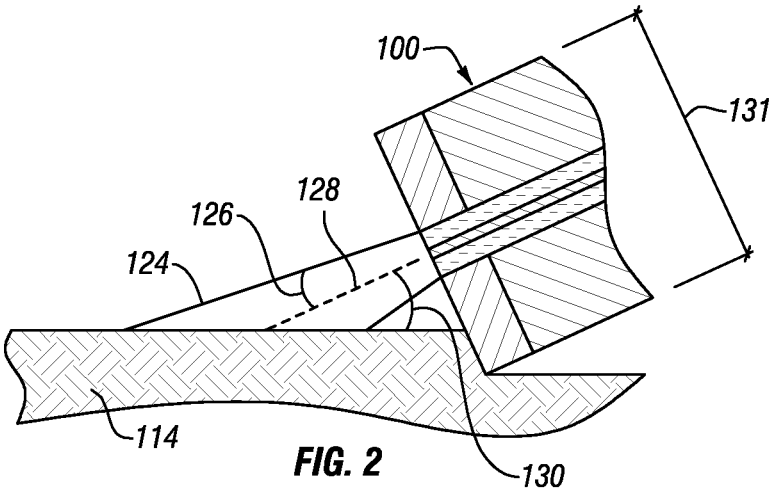
FIG. 2 is a side cross-sectional view of the energy-emitting cutting element of FIG. 1, according to some embodiments of the present disclosure.

Referring now to FIG. 2, in some embodiments, the beam 124 may have a rotationally symmetrical dispersion. For example, the beam 124 may have a circular transverse cross-section (i.e., normal to the direction of propagation of the beam 124) such that the periphery of the beam 124 is distributed at a constant beam angle 126 away from a beam axis 128. In other embodiments, the beam 124 may have non-circular dispersion. For example, the beam 124 may have a transverse cross-section that is oblong, elliptical, square, rectangular, triangular, octagonal, other regular polygonal, irregular, or combinations thereof.

In some embodiments, the beam axis 128 may at least partially determine the incident angle 130 of the beam 124 relative to the formation 114. The incident angle 130 may be an angle formed by a center of the beam 124 relative to the formation 114. In some embodiments, such as embodiments where a diffuser 122 deflects the beam 124 in a rotationally symmetrical manner, the energy angle 120, described in relation to FIG. 1, may be the same as the incident angle 130. In other embodiments, the diffuser 122 may direct the beam 124 asymmetrically, and the incident angle 130 may be different from the energy angle 120. The incident angle 130 may be in a range having lower values, upper values, or both lower and upper values including any of 0° (i.e., tangential to the formation 114), 10°, 20°, 30°, 40°, 50°, 60°, 70°, 80°, 90° (i.e., perpendicular to the formation 114), or any value therebetween. In some examples, the incident angle 130 may be between 0° and 90°. In other examples, the incident angle 130 may be between 5° and 70°. In yet other examples, the incident angle 130 may be between 10° and 50°. In further examples, the incident angle 130 may be between 15° and 30° or between 60° and 75°.

The length of the beam 124 between the cutting face 118 and the formation 114 may be different in various embodiments. In some embodiments, for instance, the length of the beam 124 may be in a range having lower values, upper values, or both lower values, upper values, or both lower and upper values including any of 0.0625 in. (1.6 mm), 0.125 in. (3.2 mm), 0.25 in. (6.4 mm), 0.50 in. (12.7 mm), 0.75 in. (19.1 mm), 1.00 in. (25.4 mm), 1.25 in. (31.8 mm), 1.50 in. (38.1 mm), 1.75 in. (44.5 mm), 2.00 in. (50.8 mm), or any value therebetween. In some examples, the length of the beam 124 may be in a range of 0.0625 in. (1.6 mm) to 2.00 in. (50.8 mm). In other examples, the length of the beam 124 may be in a range of 0.125 in. (3.2 mm) to 0.50 in. (12.7 mm). In yet other embodiments, the length of the beam 124 may be about 0.25 in. (6.4 mm). In still other embodiments, the length of the beam 124 may be less than 0.0625 in. (1.6 mm) or greater than 2.00 in. (50.8 mm).

As the beam 124 may be dispersed and the cutting element 100 may be at a face angle 116 relative to the formation 114, the length of the beam 124 may vary across the transverse cross-section of the beam 124. As used herein, the length of the beam 124 may refer to the maximum distance of the beam 124 to the formation 114 or the minimum distance of the beam 124 and the formation 124; however, unless expressly specified, the length of the beam 124 should be interpreted to be the distance along the beam axis 128.

In some embodiments, a distance the beam 124 projects in front of the cutting element 100 may be at least partially dependent on the incident angle 130 and a cutting element width 131. For example, increasing the cutting element width 131 or decreasing the incident angle 130 may project the beam 124 a greater distance along the formation 114 in front of the cutting element 100. In another example, decreasing the cutting element width 131 or increasing the incident angle 130 may project the beam 124 a lesser distance along the formation 114 in front of the cutting element 100. In some embodiments, the cutting element width 131 may be in a range having lower values, upper values, or both lower values, upper values, or both lower and upper values including any of 0.25 in. (6.4 mm), 0.50 in. (12.7 mm), 0.75 in. (19.1 mm), 1.00 in. (25.4 mm), 1.25 in. (31.8 mm), 1.50 in. (38.1 mm), 1.75 in. (44.5 mm), 2.00 in. (50.8 mm), or any value therebetween. In some examples, the cutting element width 131 may be in range of 0.25 in. (6.4 mm) to 2.00 in. (50.8 mm). In other examples, the cutting element width 131 may be in a range of 0.50 in. (12.7 mm) to 1.50 in. (38.1 mm). In yet other examples, the cutting element width 131 may be about 0.75 in. (19.1 mm). In still other embodiments, the cutting element width 131 may be less than 0.25 in. (6.4 mm) or greater than 2.00 in. (50.8 mm).

Figure 3:
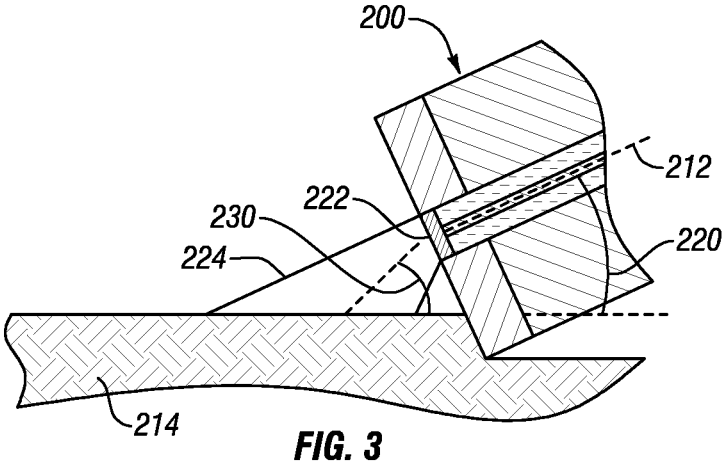
FIG. 3 is a side cross-sectional view of another energy-emitting cutting element, according to some embodiments of the present disclosure.

Referring now to FIG. 3, a cutting element 200 may have a diffuser 222 that directs a beam 224 asymmetrically. The beam 224 may therefore have an incident angle 230 relative to the formation 214 or a longitudinal axis 212 that is different (e.g., greater) than an energy angle 220 relative to the formation 214 or a longitudinal axis 212. In other embodiments, such as embodiments with the diffuser 222 inverted or rotated, the diffuser 222 may direct the beam 224 with an incident angle 230 relative to the formation 214 that is less than an energy angle 220 relative to the formation 214.

Figure 4:
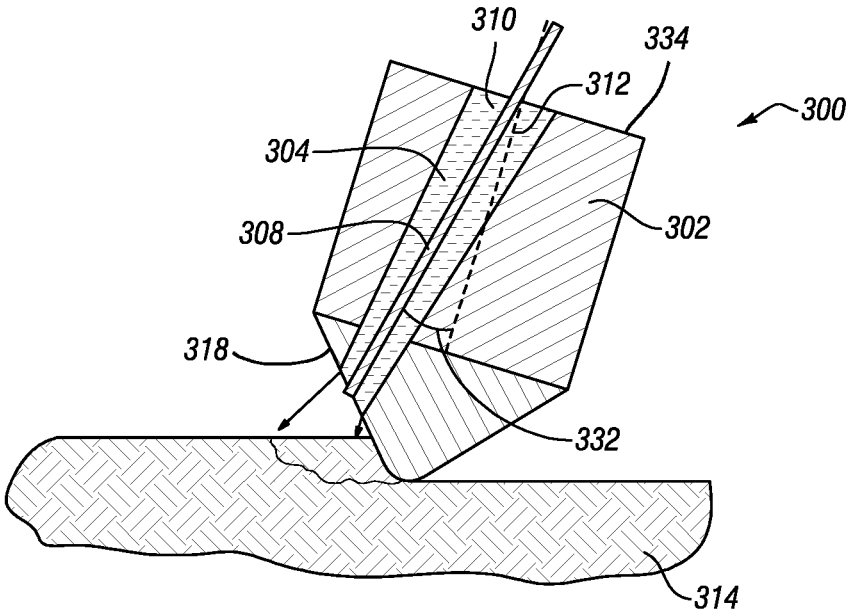
FIG. 4 is a side cross-sectional view of yet another energy-emitting cutting element, according to some embodiments of the present disclosure.

In some embodiments, the cutting element may have a planar cutting face, although in other embodiments the cutting element may include a non-planar cutting face. FIG. 4 illustrates an example cutting element 300 having a substantially conical cutting face 318 (e.g., having a pointed apex in longitudinal cross-section as shown in FIG. 4). In other embodiments, the cutting element may have a curved cutting face (e.g., having a curved apex in longitudinal cross-section), ridged, domed, or other shaped cutting face. A port 304 may extend through a body 302 of the cutting element 300. The port 304 may extend through the cutting face 318 at a non-central location on the cutting face 318. For instance, the port 304 may not be co-axial with the longitudinal axis 312, or may not exit the cutting element 310 along the longitudinal axis 312. The port 304 may include an energy direction member 308.

In some embodiments, the port 304 may have a transverse cross-section of constant dimensions. In other embodiments, the port 304 may have a transverse cross-section that varies in dimensions along a length of the port 304. A pressure, velocity, or both pressure and velocity of a fluid 310 directed through the port 304 may be at least partially dependent on the transverse cross-section of the port 304. For example, a port 304 with a decreasing transverse cross-sectional dimension may taper toward to the cutting face 318. The tapered port 304 may act as a nozzle and may cause a compressive force to build in the fluid 310 passing therethrough, increasing fluid pressure and potentially accelerating the fluid 310 toward the cutting face 318. For example, the port 304 may have a transverse cross-sectional area that decreases along the length of the port 304 by a percentage in a range having lower values, upper values, or both lower and upper values including any of 0%, 5%, 10%, 20%, 30%, 40%, 50%, or any value therebetween. In some examples, the port 304 may have a transverse cross-sectional area that decreases along the length of the port 304 by a percentage in a range of 0% to 50%. In other examples, the port 304 may have a transverse cross-sectional area that decreases along the length of the port 304 by a percentage in a range of 5% to 30%. In yet other examples, the port 304 may have a transverse cross-sectional area that decreases along the length of the port 304 by a percentage in a range of 10% to 20%. In still other embodiments, the percentage decrease may be greater than 50%.

In other embodiments, a port 304 may have an increasing transverse cross-sectional dimension toward to the cutting face 318. The fluid 310 therein may decrease in fluid pressure or decelerate as the fluid 310 moves through the port 304 toward the cutting face 318. For example, the port 304 may have a transverse cross-sectional area that increases along the length of the port 304 by a percentage in a range having lower values, upper values, or both lower and upper values including any of 0%, 5%, 10%, 20%, 30%, 40%, 50%, or any value therebetween. In some examples, the port 304 may have a transverse cross-sectional area that increases along the length of the port 304 by a percentage in a range of 0% to 50%. In other examples, the port 304 may have a transverse cross-sectional area that increases along the length of the port 304 by a percentage in a range of 5% to 30%. In yet other examples, the port 304 may have a transverse cross-sectional area that increases along the length of the port 304 by a percentage in a range of 10% to 20%. In still other embodiments, the percentage increase may be greater than 50%.

As shown in FIG. 4, at least a portion of the port 304 may extend through the body 302 at a port angle 332 relative to the longitudinal axis 312 of the body 302. For example, the port 304 may extend from a rear face 334 of the body 302 (e.g., a face opposite the cutting face 318, which may be adjacent a drill bit body) toward the cutting face 318 of the cutting element 300. The lateral position of the port 304 at the rear face 334 (relative to the longitudinal axis 312) may be different from the lateral position of the port 304 at the cutting face 318 (relative to the longitudinal axis 312). The port 304 and energy direction member 308 extending at least partially therethrough may direct energy, fluid 310, or both energy and fluid 310 from the rear face 334 toward the cutting face 318 and away from the longitudinal axis 312 such that one or more of the energy or fluid 310 is directed toward the formation 314 ahead of the cutting element 300 relative to a direction of movement (e.g., rotation) of the cutting element 300.

In some embodiments of a laser-mechanical bit body, the bit body may have a plurality of pockets or other cavities into which a cutting element may be positioned. A focused energy source may provide a focused energy to the center of a cavity, and different embodiments of cutting elements or combinations of cutting elements (e.g., cutting elements described in relation to FIGS. 1-11) may direct the energy received therefrom differently.

In some embodiments, a laser-mechanical bit may include one or more cutting elements having a symmetrical beam emitted from the cutting element, one or more cutting elements having an asymmetrical beam emitting from the cutting element, or combinations thereof. For example, a laser-mechanical bit may include one or more cutting elements having a symmetrical beam located on or near a gage or shoulder face or portion of the drill bit and one or more cutting elements having an asymmetrical beam located on a nose or cone face or portion of the drill bit. The symmetrical beam of the cutting element on the gage or shoulder face may direct energy from the cutting element directly in front of the cutting element. The asymmetrical beam of the cutting element on the nose or cone face may direct energy from the cutting element at an angle from the face of the cutting element in a lateral direction to project the beam toward the curved path of the cutting element relative to the formation.

In some embodiments, focused energy may be used to weaken at least part of a formation through the heating, fracturing, or other degrading of the material prior to mechanical removal with a cutting element. In other embodiments, focused energy may be used to harden or otherwise toughen at least a portion of the formation to resist subsequent mechanical removal of the material. For example, a sandstone formation material may be heated by energy emitted from the gage surfaces of a bit to encourage or even initiate melting of the constituent minerals, or interstitial growth between grains, to strengthen the sandstone against collapse into the wellbore. In some embodiments, the material surrounding the wellbore may expand as a result of heating or other energizing. Optionally, one or more cutting elements along a leading edge of a gage pad may be positioned, exposed, or otherwise arranged to trim any expanded formation materials.

Figure 5:
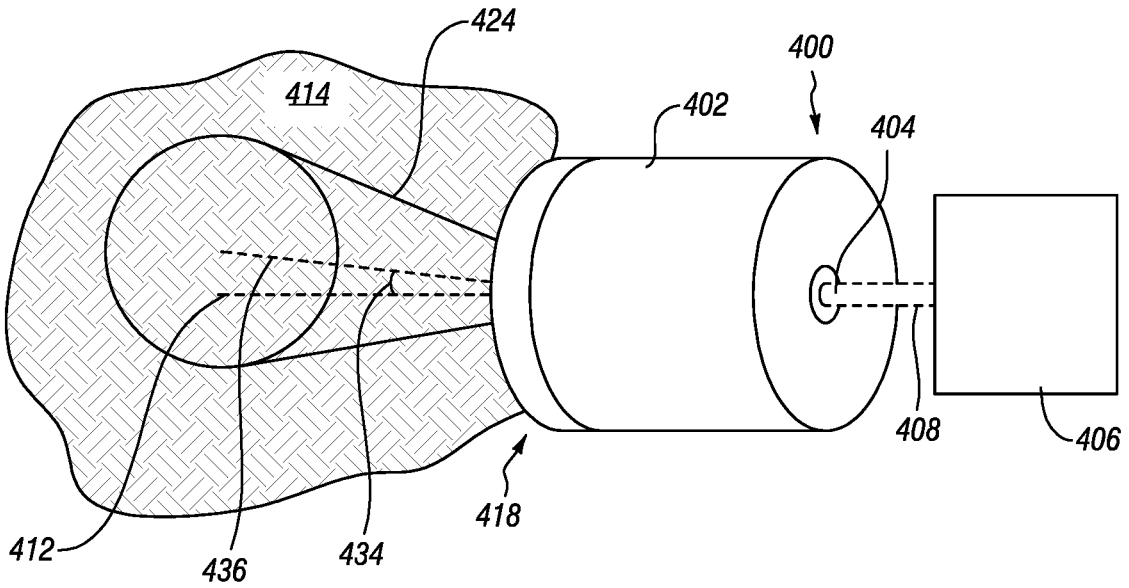
FIG. 5 is a top detail view of another energy-emitting cutting element, according to some embodiments of the present disclosure.

FIG. 5 illustrates a cutting element 400 having beam 424 emitted therefrom at a lateral angle 434, according to some embodiments of the present disclosure. The cutting element 400 may have a port 404 that extends, in some embodiments, coaxially to a longitudinal axis 412 of the cutting element 400 through a body 402 of the cutting element 400. The port 404 may include an energy direction member 408 to direct energy from a focused energy source 406 through the cutting element 400 toward a formation 414. In some embodiments, the lateral angle 434 of the beam 424 may be the angle between a beam axis 436 and the longitudinal axis 412 in a lateral direction relative to the formation 414 (i.e., orthogonal to an incident angle 230 such as described in relation to FIG. 3). For example, the lateral angle 434 may be in a range having lower values, upper values, or both lower and upper values including any of 0° (i.e., in the same plane as the longitudinal axis 412), 5°, 10°, 15°, 20°, 25°, 30°, 35°, 40°, 45°. In some examples, the lateral angle 434 may be between 0° and 45°. In other examples, the lateral angle 434 may be between 5° and 40°. In yet other examples, the lateral angle 434 may be between 10° and 35°. In further examples, the lateral angle 434 may be between 15° and 30°. In at least one embodiment, the lateral angle 434 lies in a plane normal to the cutting face 418 of the cutting element 400. In still other embodiments, the lateral angle 434 may be greater than 45°.

Figure 6:
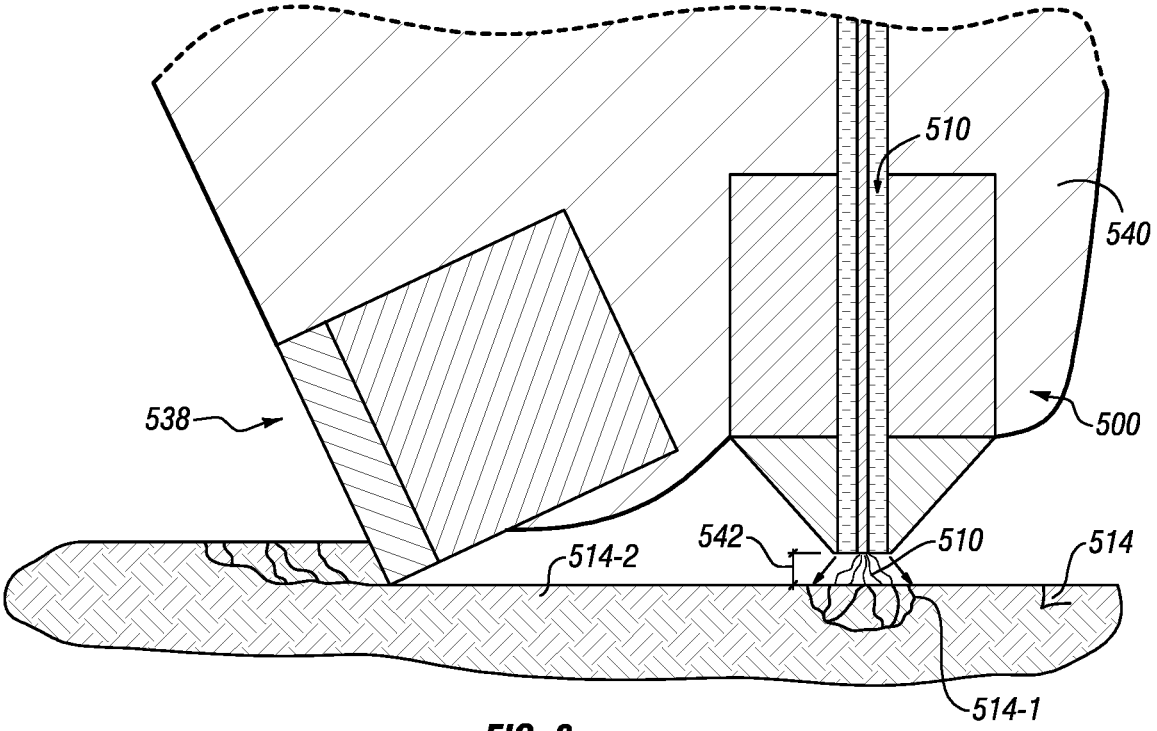
FIG. 6 is a side cross-sectional detail view of an energy-emitting cutting element and a non-emitting cutting element, according to some embodiments of the present disclosure.

In some embodiments, an energy-emitting cutting element according to some embodiments of the present disclosure may be utilized in cooperation with one or more additional cutting elements a laser-mechanical bit. For instance, a second cutting element may be a non-emitting cutting element. FIG. 6 illustrates an example of an energy-emitting cutting element 500 used in cooperation with a non-emitting cutting element 538. The energy-emitting cutting element 500 and the non-emitting cutting element 538 may be coupled to a bit body 540 of a laser-mechanical bit. For example, the energy-emitting cutting element 500 and the non-emitting cutting element 538 may be coupled to the same blade on the bit body 540, or the energy-emitting cutting element 500 and the non-emitting cutting element 538 may be coupled to different blades on the bit body 540. A laser-mechanical bit may have a bit body 540 that includes a one or more sets of energy-emitting cutting elements 500, one or more sets of non-emitting cutting elements 538, or both, to remove material from a formation 514. In some embodiments, the energy-emitting cutting element 500 may be spaced away from the formation 514 by the non-emitting cutting element 538. For example, at least a portion of the non-emitting cutting element 538 may extend farther from the bit body 540 than the energy-emitting cutting element 500.

A difference in distance from the bit body 540 may provide an energy gap 542 between the energy-emitting cutting element 500 and the formation 514. The energy gap 542 may provide space in which the formation 514 (or fluids therein) may expand or otherwise enter upon being energized by energy emitted from the energy-emitting cutting element 500. In some embodiments, the energy gap 542 may be in a range of having lower values, upper values, or both lower and upper values including 0.10 in. (2.5 mm), 0.25 in. (6.4 mm), 0.50 in. (12.7 mm), 0.75 in. (19.1 mm), 1.00 in. (25.4 mm), 1.25 in. (31.8 mm), 1.50 in. (38.1 mm), or any value therebetween. In some examples, the energy gap 542 may be in a range of 0.10 in. (2.5 mm) to 1.50 in. (38.1 mm). In other examples, the energy gap 542 may be in a range of 0.25 in. (6.35 mm) to 1.25 in. (31.8 mm). In yet other examples, the energy gap 542 may be in a range of 0.50 in. (12.7 mm) to 1.00 in. (25.4 mm). In still other embodiments, the energy gap 542 may be less than 0.10 in. (2.5 mm) or greater than 1.50 in. (38.1 mm).

In some embodiments, fluid 510 may flow through the cutting element 500 and may exit from the cutting element 500 toward the formation 514. For example, the fluid 510 may provide a conduit to transmit energy from the cutting element 500 to the formation 514. The heating or expansion of the formation 514 by the energy-emitting cutting element 500 may weaken the formation 514, allowing the non-emitting cutting element 538 to remove a weakened portion 514-1 upon movement of the bit body 540. The removal of at least part of the weakened portion 514-1 by the non-emitting cutting element 538 may provide the energy-emitting cutting element 500 access to a non-weakened portion 514-2 of the formation 514. A rotating bit body 540 may repeat the process to remove material from the formation 514. Although FIG. 6 shows the energy-emitting cutting element 500 and non-emitting cutting element 538 on the same blade, with the energy-emitting cutting element 500 in a rotationally trailing position (e.g., such that a cutting element on another blade or a further rotationally trailing position of the same blade may trim weakened material), in other embodiments a non-emitting cutting element 538 may rotationally trail the energy-emitting cutting element 500.

Figure 7:
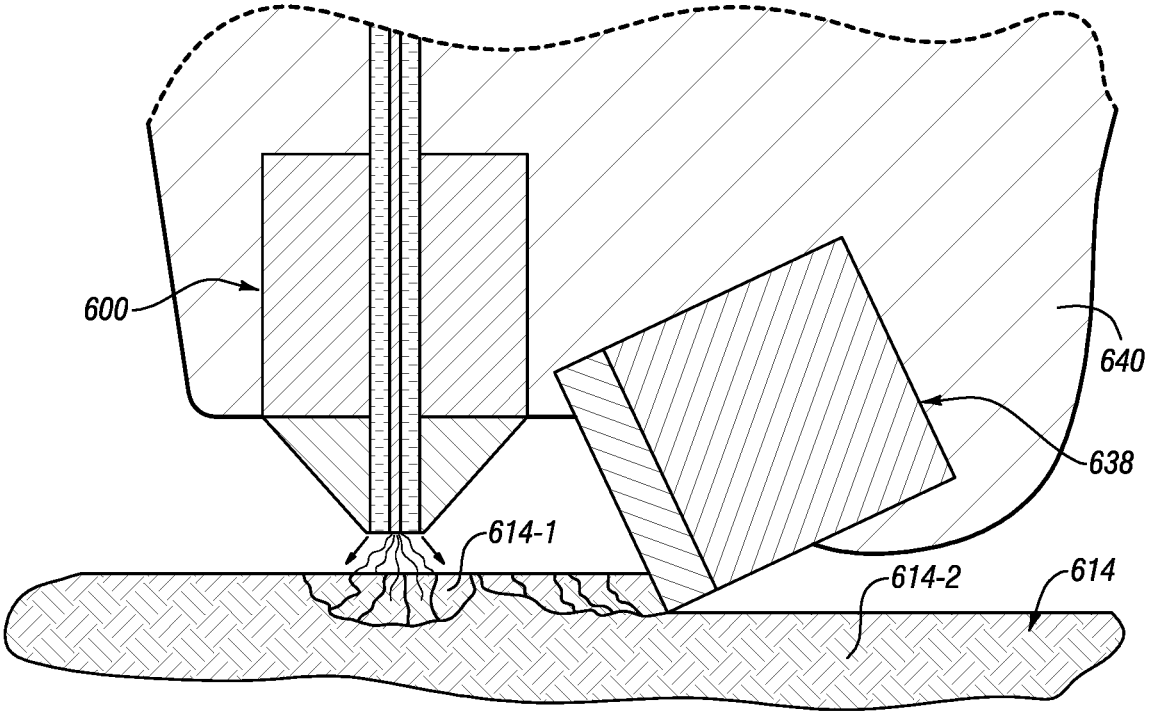
FIG. 7 is a side cross-sectional detail view of another energy-emitting cutting element and a non-emitting cutting element, according to some embodiments of the present disclosure.

A bit body may therefore include an energy-emitting cutting element used in cooperation with a non-emitting cutting element in other configurations. For example, FIG. 7 is a side cross-sectional view of a bit body 640 with an energy-emitting cutting element 600 located in front of (i.e., rotationally leading) a non-emitting cutting element 638, relative to the direction of movement of the cutting elements 600, 638 across a working surface of a formation 614. In some embodiments, the energy-emitting cutting element 600 may be positioned in front of the non-emitting cutting element 638 to direct energy at the formation 614, thereby heating or weakening the formation 614 to create a weakened portion 614-1. At least part of the weakened portion 614-1 may be engaged or removed by the non-emitting cutting element 638. Removing the weakened portion 614-1 may expose a non-weakened portion 614-2 of the formation 614.

Figure 8:
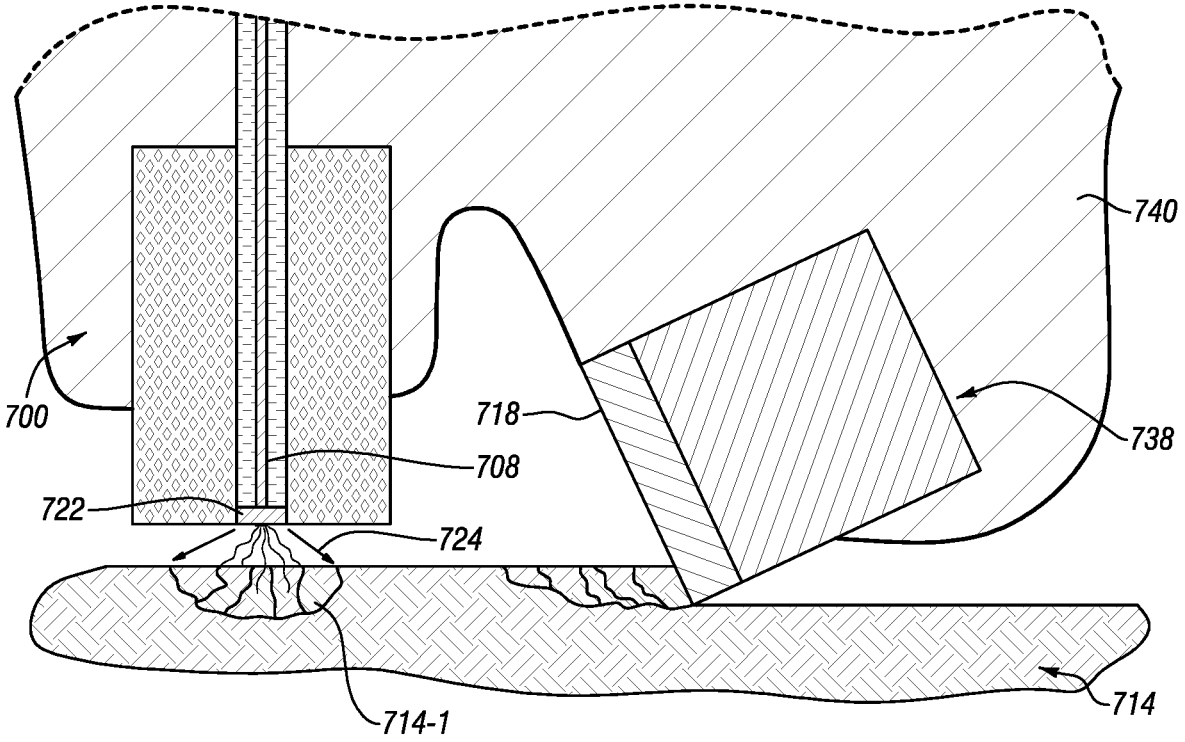
FIG. 8 is a side cross-sectional detail view of yet another energy-emitting cutting element and a non-emitting cutting element, according to some embodiments of the present disclosure.

FIG. 8 illustrates another embodiment of a bit body 740 coupled to an energy-emitting cutting element 700 and a non-emitting cutting element 738. In some embodiments, the energy-emitting cutting element 700 may include an impregnated insert (i.e., an insert or element that is impregnated with ultrahard material particles), such as a GHI. The impregnated insert may form a full or partial portion of the cutting element 700. An energy-emitting cutting element 700 including an impregnated insert may protect an energy direction member 708 or other energy direction member extending therethrough from damage while a non-emitting cutting element 738 may engage a formation 714 and remove material therefrom. For example, the non-emitting cutting element 738 may include or be made of a material that has a greater hardness than the impregnated insert.

In some embodiments, the non-emitting cutting element 738 may be a shear cutter having a substantially circular cutting face 718. In some embodiments, an energy-emitting cutting element 700 may include a diffuser 722 in communication with an energy direction member 708 to direct the beam 724. In some embodiments, the beam 724 may be configured to energize a portion of the formation 714 such that a weakened portion 714-1 is substantially the same width as the cutting face 718 of the non-emitting cutting element 738. In other embodiments, the beam 724 may be configured to energize a portion of the formation 714 such that a weakened portion 714-1 is substantially the same width as a cutting path of the non-emitting cutting element 738. For example, the cutting path of the cutting face 718 of the non-emitting cutting element 738 may be at least partially dependent upon a depth of cut of the non-emitting cutting element 738. In some embodiments, the cutting path of a shear cutter non-emitting cutting element 738 may be a percentage of a width of the non-emitting cutting element 738 in a range having lower values, upper values, or both lower and upper values including any of 10%, 20%, 30%, 40%, 50%, 60%, 70%, 80%, 90%, 100%, or any values therebetween. For example, the cutting path may be between 10% and 100% of a width of the non-emitting cutting element 738. In other examples, the cutting path may be between 20% and 90% of a width of the non-emitting cutting element 738. In yet other examples, the cutting path may be between 30% and 80% of a width of the non-emitting cutting element 738. In still other embodiments, the cutting path may be less than 10% or more than 100% of the width of the non-emitting cutting element 738.

Figure 9:
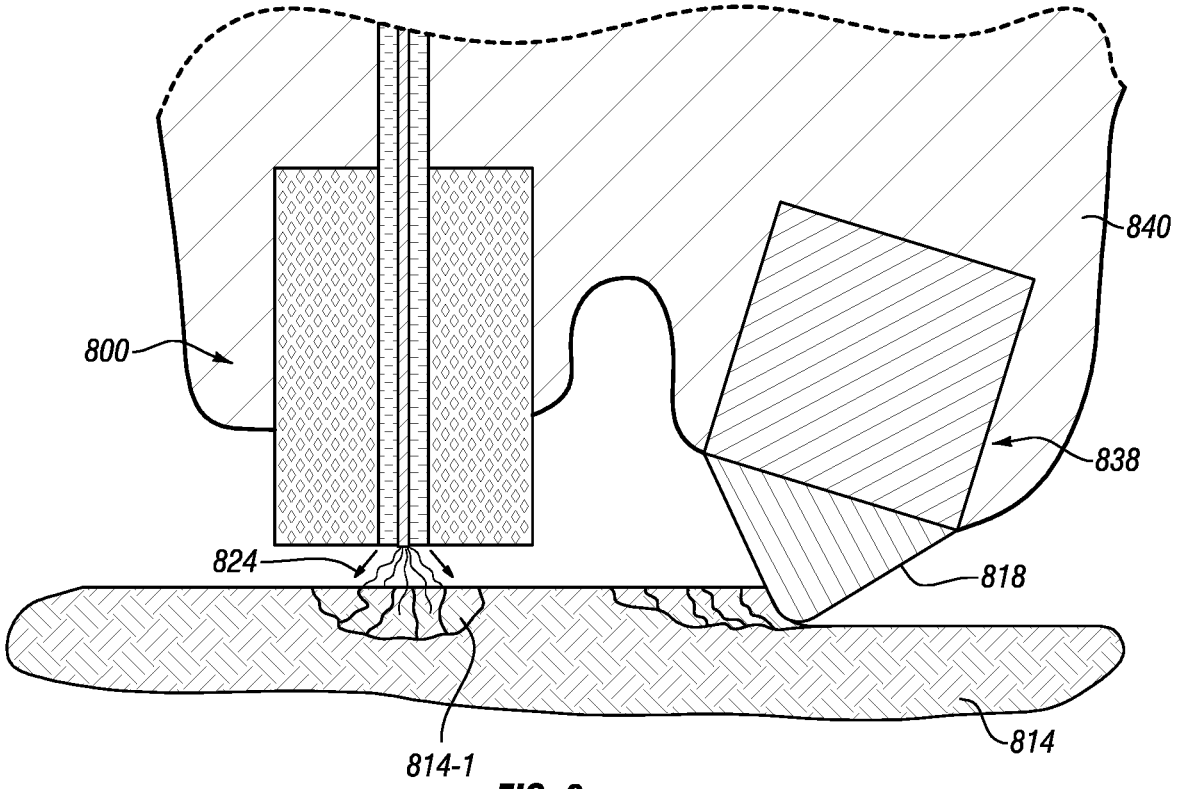
FIG. 9 is a side cross-sectional detail view of additional energy-emitting and non-emitting cutting elements, according to some embodiments of the present disclosure.

As illustrated in FIG. 9, in other embodiments, a non-emitting cutting element 838 may be a conical cutter (such as a STINGER® cutting element) with a substantially conical cutting face 818. The energy-emitting cutting element 800 may be coupled to a bit body 840 forward of (i.e., rotationally leading) the conical non-emitting cutting element 838 and be configured to direct a beam 824 of energy toward the formation 814 in a narrower or otherwise more focused area in comparison to the energy-emitting cutting element 700 described in relation to FIG. 8. Referring again to FIG. 9, the conical non-emitting cutting element 838 may have a narrower cutting path, a deeper cutting path, or both a narrower and deeper cutting path. The weakened portion 814-1 of the formation 814 may be deeper and narrower with a more focused beam 824, such that the cutting path of the non-emitting cutting element 838 is about the same depth as, aligned with, or otherwise complimentary to the weakened portion 814-1.

Figure 10:
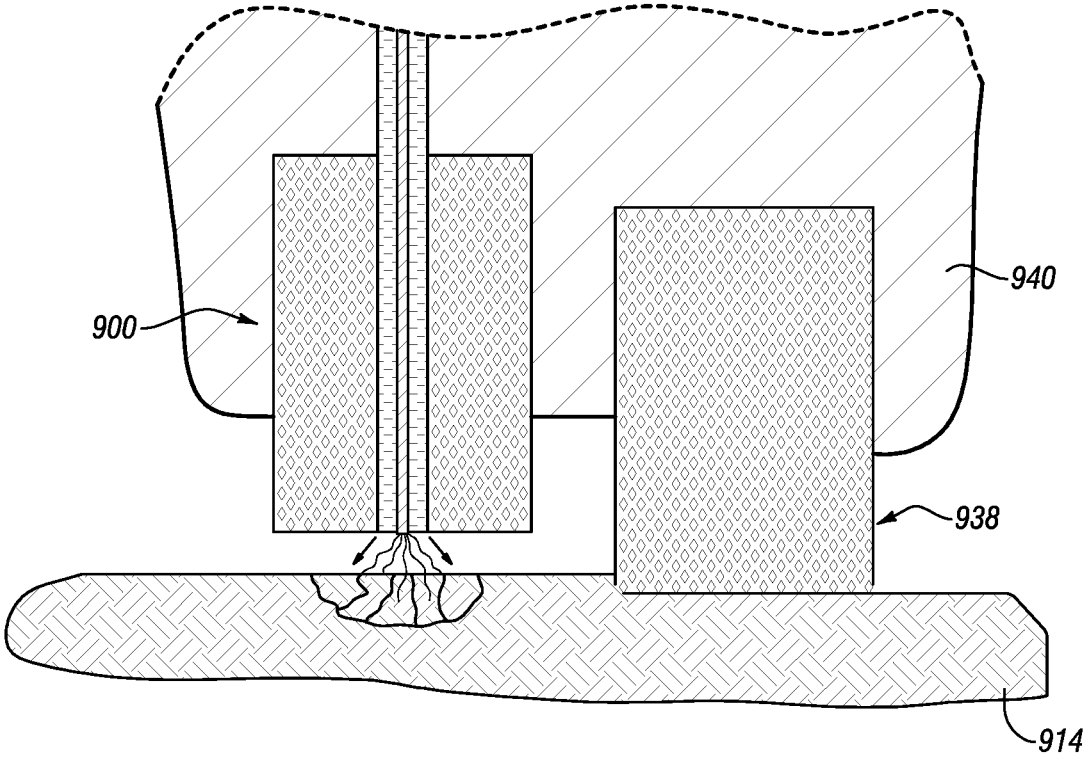
FIG. 10 is a side cross-sectional detail view of a yet further energy-emitting cutting element and a non-emitting cutting element, according to some embodiments of the present disclosure.

In yet another embodiment, as depicted in FIG. 10, both an energy-emitting cutting element 900 and a non-emitting cutting element 938 may be or include an impregnated insert such as a GHI. For example, the energy provided by the energy-emitting cutting element 900 may weaken the formation 914 sufficiently such that an impregnated insert may remove material from the formation 914 as efficiently as a PDC cutting element, even potentially where the impregnated insert has a hardness that is less than a PDC cutting element. Pressing, sintering, or otherwise forming the impregnated insert energy-emitting cutting element 900 or non-emitting cutting element 938 in the bit body 940 may reduce costs, manufacturing time, and the like, without a degradation in material removal capacity of the energy-emitting cutting element 900 and non-emitting cutting element 938.

Figure 11:
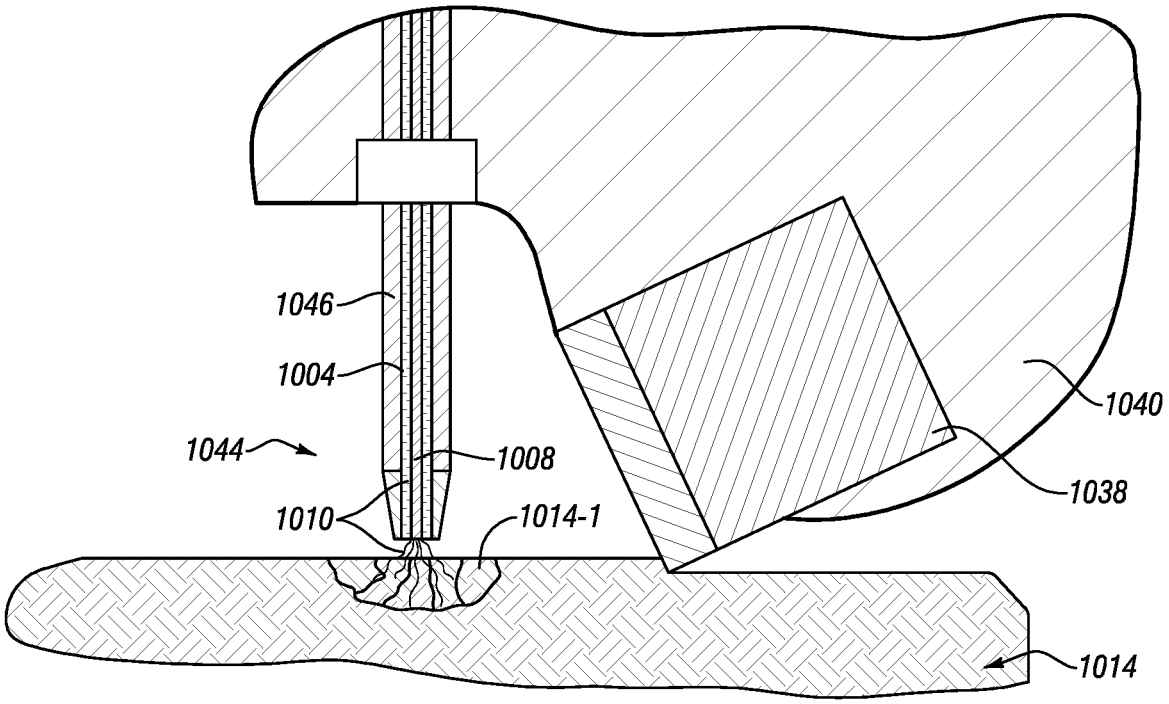
FIG. 11 is a side cross-sectional detail view of an energy-emitting fluid nozzle and a non-emitting cutting element, according to some embodiments of the present disclosure.

FIG. 11 illustrates a non-emitting cutting element 1038 configured to remove material from a weakened portion 1014-1 of a formation 1014 that has been energized by an energy-emitting non-cutting element, such as an energy-emitting fluid nozzle 1044. A bit body 1040 may have one or more fluid nozzles or other non-cutting elements therein to direct drilling fluid through the bit body 1040 toward the formation 1014. The fluid may be used to clear debris from and lubricate any combination of the cutting elements, the bit body 1040, the formation, or other downhole components or materials. In some embodiments, the fluid nozzle may be an energy-emitting fluid nozzle 1044. An energy-emitting fluid nozzle 1044 may include at least one of a port 1004 or an energy direction member 1008 (e.g., extending through the port 1004) to deliver a fluid 1010 and energy. In some embodiments, the fluid 1010 may be a drilling fluid that is provided to lubricate or cool the bit body 1040, the non-emitting cutting element 1038, or both. In the same or other embodiments, the fluid 1010 may be a transmission fluid, as described herein, and used to transmit energy from the energy direction member 1008 to the formation 1014 and aid in creating a weakened portion 1014-1 of the formation 1014. The energy-emitting fluid nozzle 1044 or the port 1004 may be oriented relative to the formation 1014 in any manner described in relation to the energy-emitting cutting element in relation to FIG. 1 through FIG. 10. In some embodiments, the energy-emitting fluid nozzle 1044 may be positioned forward (i.e., to rotationally lead) or behind (e.g., to rotationally trail) the non-emitting cutting element 1038, relative to the direction of movement of the bit body 1040 during operation of the laser-mechanical bit. In some embodiments, the energy-emitting fluid nozzle 1004 may be at a same radial position as a corresponding non-emitting cutting element 1038, although in other embodiments they may be offset at different radial positions. In some embodiments, the energy-emitting fluid nozzle 1044 may be used in cooperation with one or more energy-emitting cutting elements, including those described herein.

Figure 12:
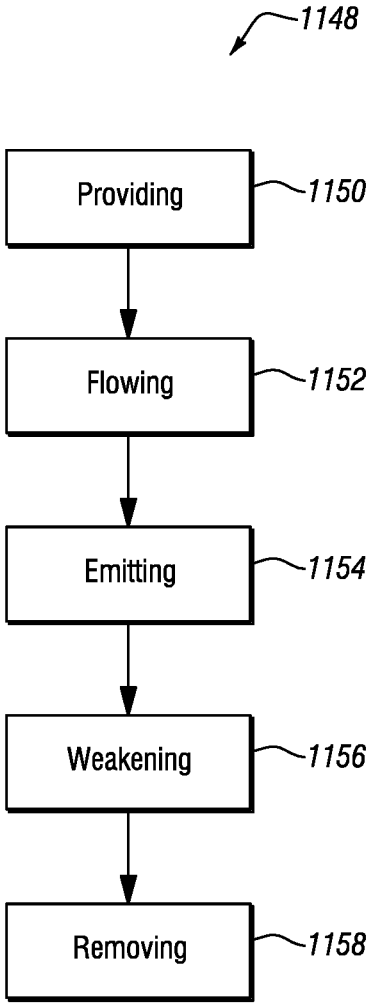
FIG. 12 is a flowchart depicting a method of removing material from a formation, according to some embodiments of the present disclosure.

FIG. 12 illustrates a method 1148 for removing material from a formation that may include providing 1150 a bit including at least one energy-emitting element (e.g., a cutting element or fluid nozzle). The method 1148 may include flowing 1152 a fluid through the energy-emitting element and emitting energy from the energy-emitting element. The energy may be considered to be focused when provided from a focused energy source, such as but not limited to a laser, even where the energy is diffused as discussed herein. The method 1148 may include weakening 1156 at least a part of the formation through that application of the energy or fluid thereto. The method 1148 may include removing 1158 at least a part of the weakened portion of the formation. In some examples, removing 1158 at least a part of the weakened portion may include removing 1158 the material with the energy-emitting cutting insert or other cutting element. In the same or other embodiments, removing 1158 at least a part of the weakened portion may include removing 1158 the material with a non-emitting cutting element.

Figure 13:
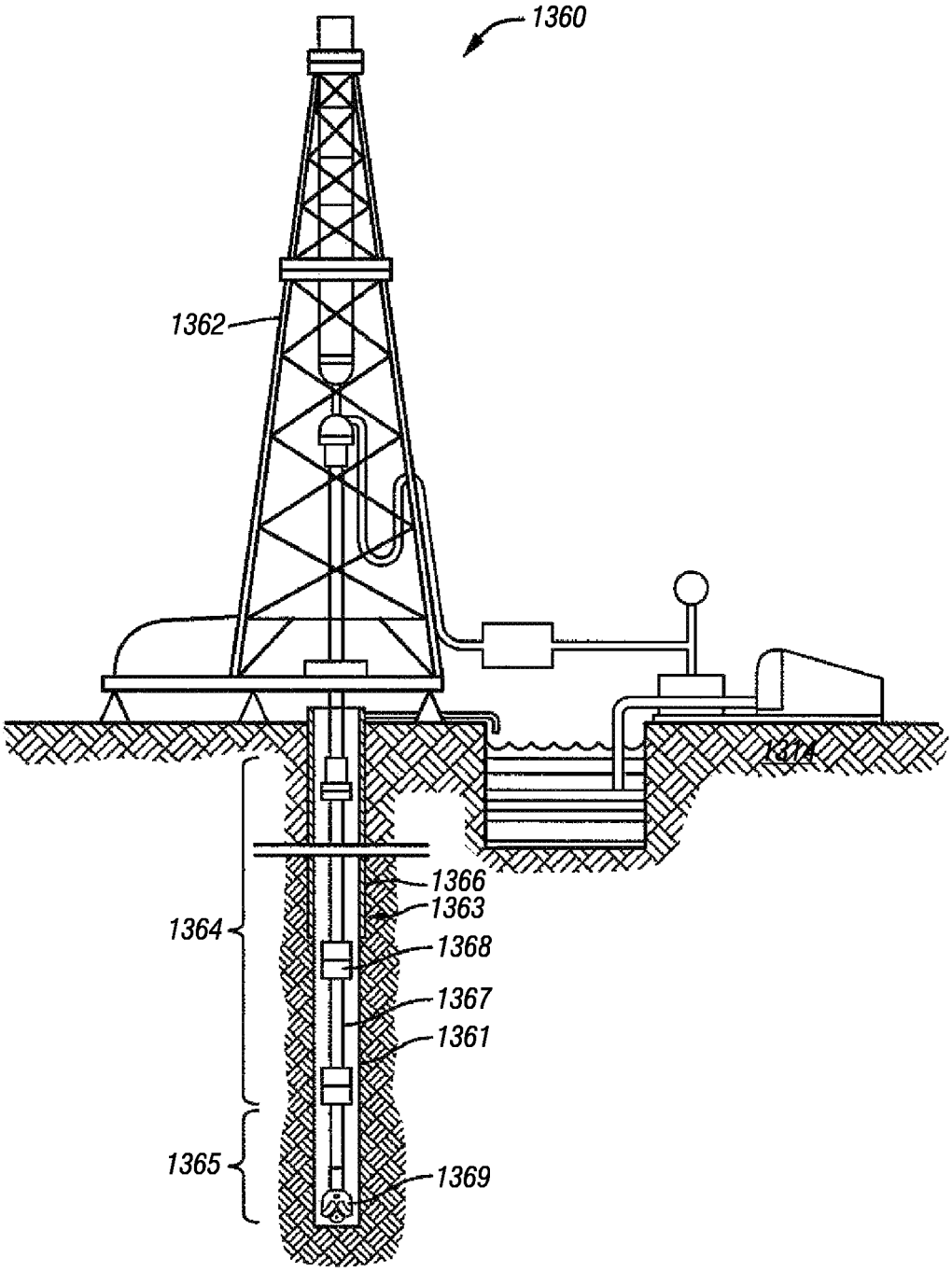
FIG. 13 is a schematic illustration of a drilling system, according to some embodiments of the present disclosure.

FIG. 13 shows one example of a drilling system 1360 for drilling an earth formation 1314 to form a wellbore 1361. The drilling system 1360 includes a drill rig 1362 used to turn a drilling tool assembly 1363 which extends downward into the wellbore 1361. The drilling tool assembly 1363 may include a drill string 1364, a bottomhole assembly ("BHA") 1365, and a bit 1369, coupled to the downhole end of drill string 1364.

The drill string 1364 may include several joints of drill pipe 1367 a coupled end-to-end through tool joints 1368. The drill string 1364 transmits drilling fluid through a central bore and transmits rotational power from the drill rig 1362 to the BHA 1365. In some embodiments, the drill string 1364 may further include additional components such as subs, pup joints, etc. The drill pipe 1367 provides a hydraulic passage through which drilling fluid is pumped from the surface. The drilling fluid discharges through selected-size nozzles, jets, or other orifices in the bit 1369 for the purposes of cooling the bit 1369 and cutting structures thereon, and for lifting cuttings out of the wellbore 1361 as it is being drilled.

The BHA 1365 may include the bit 1369 or other components. An example BHA 1365 may include additional or other components (e.g., coupled between to the drill string 1364 and the bit 1369). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing.

In general, the drilling system 1360 may include other drilling components and accessories, such as special valves (e.g., kelly cocks, blowout preventers, and safety valves). Additional components included in the drilling system 1360 may be considered a part of the drilling tool assembly 1363, the drill string 1364, or a part of the BHA 1365 depending on their locations in the drilling system 1360.

The bit 1369 in the BHA 1365 may be any type of bit suitable for degrading downhole materials. For instance, the bit 1369 may be a drill bit suitable for drilling the earth formation 1314. Example types of drill bits used for drilling earth formations are fixed-cutter or drag bits (see FIG. 14). In other embodiments, the bit 1369 may be a mill used for removing metal, composite, elastomer, or other materials downhole. For instance, the bit 1369 may be used with a whipstock to mill into casing 1366 lining the wellbore 1361. The bit 1369 may also be a junk mill used to mill away tools, plugs, cement, or other materials within the wellbore 1361. Swarf or other cuttings formed by use of a mill may be lifted to surface, or may be allowed to fall downhole.

Figure 14:
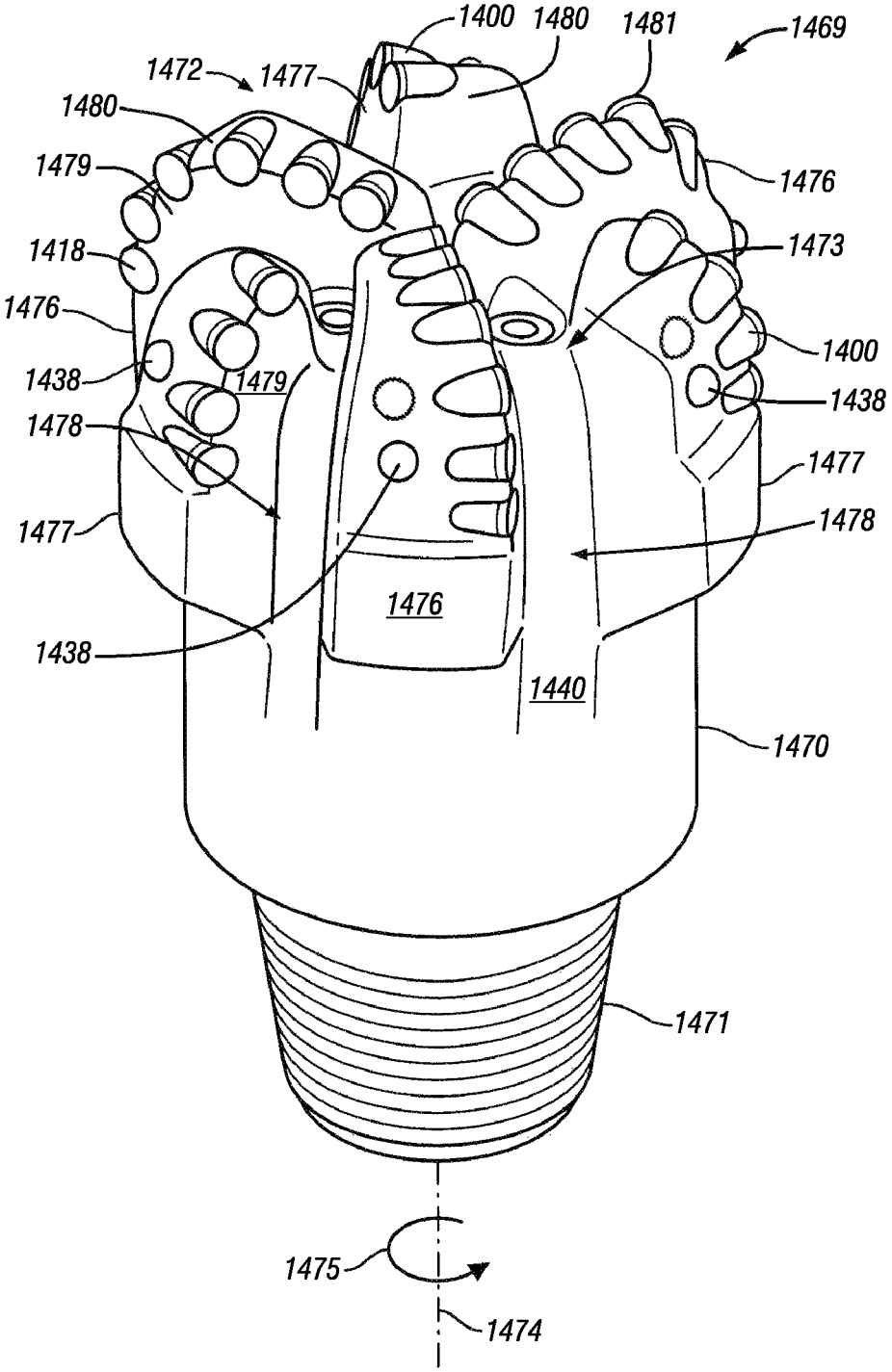
FIG. 14 is a perspective view of a bit for use in downhole operations, according to some embodiments of the present disclosure.

Referring to FIG. 14, an example fixed cutter or drag bit 1469 adapted for drilling through formations of rock to form a wellbore is shown. The bit 1469 generally includes a bit body 1440, a shank 1470, and a threaded connection or pin 1471 for coupling the bit 1469 to a drill string (e.g., drill string 1364 of FIG. 13) that is employed to rotate the bit 1469 in order to drill the borehole. A bit face 1472 supports a cutting structure 1473 and is formed on, or coupled to, a cutting end portion of the bit 1469 that is opposite the pin 1471. The bit 1469 further includes a central axis 1474 about which bit 1469 rotates in a cutting direction represented by arrow 1475.

The cutting structure 1473 is provided on the face 1472 of the bit 1469. The cutting structure 1473 may include a plurality of angularly spaced-apart primary blades 1476 and secondary blades 1477, each of which may extend from the bit face 1472. The primary blades 1476 and the secondary blades 1477 may extend generally radially along the bit face 1472 and then axially along a portion of the periphery of the bit 1469; however, the secondary blades 1477 are shown as extending radially along the bit face 1472 from a position that is offset from the central axis 1474 toward the periphery of the bit 1469. Thus, a secondary blade may refer to a blade that begins at some distance from the bit axis and extends generally radially along the bit face to the periphery of the bit. The primary blades 1476 and the secondary blades 1477 are separated by drilling fluid flow courses or junk slots 1478.

Referring still to FIG. 14, each primary and secondary blade 1476, 1477 may include a forward facing surface 1479 that faces the cutting direction 1475, and a top or formation facing surface 1480 that faces radially outward toward a bottom or end of a wellbore, and toward the sides of the wellbore. A plurality of elements 1400, 1438 may be mounted in or otherwise coupled to the primary and secondary blades 1476, 1477. In particular, cutting elements 1400, each having a cutting face 1418, may be face or front loaded into pockets formed in the blades 1476, 1477. For instance, the pockets may be formed in one or both of the forward facing surface 1479 or the formation facing surface 1480, and may extend generally along the periphery of the primary and secondary blades 1476, 1477. The cutting elements 1400 may be arranged adjacent one another in a radially extending row proximal the leading edge at the interface of the forward facing and formation facing surfaces 1479, 1480. Each cutting face 1418 may have an outermost cutting tip 1481 farthest from formation facing surface 1480 to which the cutting element 1400 is coupled. While the cutting face 1418 is shown as being generally planar such that the cutting element 1400 is a shear cutting element, in other embodiments the cutting face 1418 may have non-planar shapes (e.g., ridged, domed, conical, frusto-conical, bullet-shaped, etc.). In some embodiments, the cutting elements 1400 may be energy-emitting cutting elements. In other embodiments, the cutting elements 1400 may be non-emitting cutting elements. In still other embodiments, some of the cutting elements 1400 may be energy-emitting cutting elements and others may be non-emitting cutting elements.

One or more additional elements 1438 may also be coupled to the blades 1476, 1477. In FIG. 14, for instance, the elements 1438 may be coupled to the formation facing surfaces 1480 of the primary and secondary blades 1476, 1477. The elements 1438 may be behind or trail the cutting elements 1400 when the bit 1469 rotates in the cutting direction 1475. The elements 1438 may be top loaded into pockets formed in the blades 1476, 1477. For instance, pockets may be formed in the formation facing surface and may extend radially inward within the primary and secondary blades 1476, 1477. The elements 1438 may include cutting elements having a cutting face similar to the cutting face 1418 described above. In other embodiments, the elements 1438 may be used for other purposes, such as limiting the depth of cut of the cutting elements 1400 or providing focused energy to the formation. In some embodiments, the elements may have a domed or curved surface 1482 for making contact with the formation or for emitting energy. In other embodiments, however, the surface 1482 may have other configurations (e.g., planar, ridged, conical, frusto-conical, bullet-shaped, etc.).

In some embodiments, the elements 1438 may be energy-emitting cutting elements. In other embodiments, the elements 1438 may be non-emitting cutting elements. In still other embodiments, some of the elements 1438 may be energy-emitting cutting elements and others may be non-emitting cutting elements. The cutting elements 1400 and the elements 1438 may have any suitable exposure relative to the formation facing surface 1480, and may be oriented at any suitable angle (e.g., side rake angle, back rake angle, etc.)

Although embodiments of cutting devices and assemblies have been described primarily with reference to wellbore drilling, drill bit, or other downhole operations, the cutting devices and assemblies described herein may be used in applications other than the drilling of a wellbore. In other embodiments, for instance, cutting devices and assemblies may be used outside a wellbore or other downhole environment used for the exploration or production of natural resources. For instance, cutting devices and assemblies of the present disclosure may be used in a borehole used for placement of utility lines, mining equipment, or explosives. In other embodiments, cutting devices and assemblies of the present disclosure may be used in the manufacturing industry. Accordingly, the terms "wellbore," "borehole," and the like should not be interpreted to limit tools, systems, assemblies, or methods of the present disclosure to any particular industry, field, or environment.

The articles "a," "an," and "the" are intended to mean that there are one or more of the elements in the preceding descriptions. Any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses, are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. The terms "coupled," "attached,", "secured," "mounted," "connected," and the like refer to both direct connections without one or more intermediate components, as well as indirect connections having one or more intermediate components therebetween. Components or features that are integrally formed to have a unitary construction should also be considered to be coupled together.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An energy-emitting cutting element, the cutting element comprising:

a body having a rear face, a cutting face, and a longitudinal axis extending therethrough, the cutting face including an ultrahard material;

a port extending through at least a portion of the body and the cutting face parallel to the longitudinal axis, the port being configured to provide fluid communication through at least a portion of the cutting element; and an energy direction member extending within at least part of the port.

2. The cutting element of claim 1, the energy direction member extending a full length of the port.

3. The cutting element of claim 1, the port being coaxial to the longitudinal axis.

4. The cutting element of claim 1, the port having a uniform cross-sectional area along a length of the port.

5. The cutting element of claim 1, further comprising a diffuser in communication with the energy direction member.

6. The cutting element of claim 1, wherein the cutting face includes a conical portion.

7. The cutting element of claim 6, wherein the port exits the cutting face in a non-central location on the cutting face.

8. A laser-mechanical bit comprising:

a bit body having a first longitudinal axis, the bit body including a cavity a focused energy source directing focused energy to the cavity; and an energy-emitting cutting element coupled to the bit body in the cavity, the energy-emitting cutting element including:

a body having a second longitudinal axis extending therethrough, the body including a cutting face that includes an ultrahard material, the first longitudinal axis and second longitudinal axis having a non-zero angle therebetween;

a port extending through at least a portion of the body and the cutting face parallel to the second longitudinal axis, the port being configured to provide fluid communication through the at least a portion of the body; and an energy direction member extending within at least part of the port, the energy direction member receiving the focused energy directed to the cavity from the focused energy source and directing the focused energy through the energy-emitting cutting element through the port.

9. The bit of claim 8, further comprising a non-emitting cutting element coupled to the bit body.

10. The bit of claim 9, the bit body further comprising at least one bit blade, the energy-emitting cutting element and the non-emitting cutting element being coupled to the at least one bit blade.

11. The bit of claim 8, the energy direction member being a fiber-optic member in communication with the focused energy source.

12. The bit of claim 8, the focused energy source being a laser with an output energy between 10 kW and 80 kW.

13. The bit of claim 8, further comprising a fluid at least partially located in the port.

14. The bit of claim 13, the fluid being a drilling fluid.

15. The bit of claim 13, the fluid being at least 50% transmissive at an emission wavelength of the focused energy source.

16. The bit of claim 8, the port being having a transverse cross-sectional area that tapers toward the cutting face.

17. A method of removing material from a formation, the method comprising:

providing an energy-emitting cutting element having a port extending at least partially through an ultrahard material on a cutting face of the energy-emitting cutting element, the energy-emitting element being inserted into a cavity in a bit;

flowing a fluid through the port of the energy-emitting cutting element;

providing focused energy to the cavity from a focused energy source;

directing the focused energy from the cavity through the port with an energy direction member;

emitting the focused energy from the port of the energy-emitting cutting element toward an energized portion of a formation at a non-perpendicular incident angle to the formation;

weakening at least part of the formation by the energizing, heating, or expanding the energized portion of the formation; and removing a weakened portion of the formation through mechanical removal.

18. The method of claim 17, removing a weakened portion of the formation including mechanically removing the weakened portion with a cutting face of the energy-emitting cutting element.

19. The method of claim 17, emitting energy from the port including directing energy through at least a portion of the port with a fiber optic member.

20. The method of claim 17, weakening at least part of the formation including heating the fluid to apply a force to the formation.

* * * * *